US005685792A

United States Patent [19]

Ruoff

[11] Patent Number: 5,685,792

[45] Date of Patent: Nov. 11, 1997

[54] STREET AND ICE HOCKEY STICK

[75] Inventor: Rodney Scott Ruoff, Menlo Park, Calif.

[73] Assignee: RSR Enterprises, Inc., Jefferson City, Mo.

[21] Appl. No.: 561,912

[22] Filed: Nov. 22, 1995

[51] Int. Cl.[6] ..... A63B 59/14

[52] U.S. Cl. ..... 473/563

[58] Field of Search ..... 273/67 R, 67 A; 473/563

[56] References Cited

U.S. PATENT DOCUMENTS

| | | | |
|---|---|---|---|
| 676,736 | 6/1901 | Dean . | |
| 1,821,889 | 9/1931 | Glahe . | |
| 2,774,600 | 12/1956 | Reach | 273/174 |
| 3,377,065 | 4/1968 | White, Sr. | 273/67 |
| 3,529,825 | 9/1970 | White et al. | 273/67 |
| 3,680,868 | 8/1972 | Jacob | 273/174 |
| 3,982,760 | 9/1976 | Tiitola | 273/67 |
| 4,059,269 | 11/1977 | Tiitola | 273/67 |
| 4,111,419 | 9/1978 | Pellegrino | 273/128 R |
| 4,343,468 | 8/1982 | Lindgren | 273/67 A |
| 4,452,451 | 6/1984 | Dubreuil | 273/67 A |
| 4,488,721 | 12/1984 | Franck et al. | 273/67 |
| 5,275,410 | 1/1994 | Bellehumeur et al. | 273/128 R |
| 5,294,113 | 3/1994 | Ladouceur et al. | 273/67 |
| 5,366,219 | 11/1994 | Salcer et al. | 273/128 R |

FOREIGN PATENT DOCUMENTS

| | | | |
|---|---|---|---|
| 2 487 208 | 1/1982 | France | A63B 59/12 |

*Primary Examiner*—Mark S. Graham

*Attorney, Agent, or Firm*—Limbach & Limbach L.L.P.

[57] ABSTRACT

An ice, street or roller hockey stick having a stick blade that prevents excessive wear. The stick includes a plurality of rods or members inserted in the bottom edge of the stick's blade. The rods or members are made of a material exhibiting higher wear resistance characteristics than the material used to form the bottom edge of the blade.

34 Claims, 5 Drawing Sheets

STREET AND ICE HOCKEY STICK

FIELD OF THE INVENTION

The present invention relates to hockey sticks, and in particular to a hockey stick with an improved blade for playing street or roller hockey on a paved surface.

BACKGROUND OF THE INVENTION

For the past several years, street and roller hockey has been one of the fastest growing team sports in the United States. Street hockey is played on a paved surface, such as asphalt or concrete. Such a surface is cheaper and more accessible than playing ice hockey in an ice rink. Street hockey is typically played with a hockey stick and either a ball or a plastic puck similar in appearance to an ice hockey puck. Roller hockey is the same as street hockey, but the players wear roller skates or in-line skates.

The blade portion of hockey sticks is typically made from wood or from composite materials such as plastic or wood laminated with fiberglass mesh and epoxy. Paved surfaces such as asphalt and concrete are rough and abrasive. Playing hockey on such a surface tends to wear down the stick blade very quickly. When a hockey player handles, passes and shoots the ball or puck, the blade of the hockey stick rubs on the paved surface, which abrades the stick blade. Also, hockey players often push or drag the stick against the playing surface during hockey play, further abrading the stick blade. As a stick blade wears down, it becomes less effective for handling, passing and shooting the puck or ball.

With the advent of the in-line skate, there is a trend to make roller hockey "feel" more like ice hockey. The challenge has been to make a hockey stick which allows players to handle, pass and shoot with the same "feel" as if,playing with an ice hockey stick on a relatively frictionless ice surface. Yet, the abrasiveness of the paved surface causes high friction between the paved surface and the stick blade. The high friction detracts from the feel of playing hockey on the paved surface. More importantly, however, is that this high abrasion causes the stick blade to suffer extreme wear in just a short amount of play time.

Street hockey stick blades typically have at least the bottom edge formed of acrylonitrile butadiene styrene (ABS) plastic. The plastic blade is attached to a long handle portion, typically made of wood. A plastic blade travels over a paved surface without the splintering problems associated with wooden blades when played on a paved surface. Plastic hockey stick blades, however, abrade very quickly on a paved surface. In fact, with continual use, such a blade could wear to the point of being unusable (about one inch of wear) in a matter of weeks.

A number of specially designed stick blades have been used to reduce the friction between the blade and the playing surface, as well as to reduce the amount of wear on the blade due to abrasion with the playing surface. These designs typically have limited results, and detract from the performance of the stick. For example, plastic edges can be strapped onto a wooden blade, as described in U.S. Pat. No. 5,249, 113. The plastic edges, however, tend to alter the stick blade weight, shooting surface geometry, and weight distribution, which intolerably changes the performance of the hockey stick. Moreover, this design fails to reduce the wear on the plastic edge, resulting in the need to routinely replace the plastic edges.

Other designs incorporate composite blades with allegedly hard-wearing or wear resistant materials extending from the bottom edge of the blade, such as those described in U.S. Pat. Nos. 3,982,760, 4,059,269, and 4,488,721. Yet, these allegedly hard wearing materials are simply plastic incorporated at the bottom surface of the blade, which fails to provide adequate wear resistance. Further, these complicated designs can be relatively expensive to manufacture, and difficult to incorporate into a stick blade for mass production.

Another stick blade design incorporates a road adapter for a hockey stick to reduce friction between the blade and the playing surface. The adapter includes a plurality of ball bearings placed in a spaced relationship along the lower edge of the hockey stick blade, which is described in U.S. Pat. No. 3,529,825. The ball bearings allegedly rotate when in contact with the playing surface to reduce friction between the stick blade and the playing surface. In reality, however, such ball bearings are prone to deformation or debris interference that may prohibit free rotation of the bearings during use. Further, such a design is undesirable because the protruding ball bearings may cause injury or damage to other players and/or the playing surface. Moreover, such a design alters the playing performance of the stick by changing the weight distribution of the stick, and by preventing the stick's bottom edge from contacting the playing surface.

In fact, even wooden blades played on a relatively smooth ice surface suffer intolerable wear on their bottom edges. There is a need for a street or ice hockey stick that prevents excessive abrasive wear of the stick blade from the playing surface without detrimentally affecting the hockey stick's performance or cost to manufacture.

SUMMARY OF THE INVENTION

The present invention solves the aforementioned problems by providing a hockey stick blade that exhibits enhanced wear resistance characteristics during use, while simultaneously preserving the performance of the hockey stick.

The wear-resistant blade of the present invention drastically reduces the wear of the hockey stick blade for play on a variety of rough surfaces, such as asphalt and concrete, as well as smoother surfaces such as ice. The blade of the present invention does not detrimentally alter the play performance of the stick. The invention maintains the stick's geometry, weight, weight distribution, and blade smoothness. The blade of the present invention is inexpensive and easy to incorporate into mass production of hockey sticks.

The stick blade of the present invention includes a blade portion having a bottom edge. The blade portion is made of a material having desired playing characteristics on the intended playing surface. A plurality of rods are formed or inserted into the blade and extend to the bottom edge thereof. The rods are formed of a material having higher wear resistance than the material used to make the blade portion.

Other objects and features of the present invention will become apparent by a review of the specification and appended figures.

DETAILED DESCRIPTION OF THE PREFERRED EMBODIMENTS

The present invention is a street hockey stick that reduces abrasive wear on the bottom edge of the stick blade without adversely affecting the playing performance of the stick. The present invention is inexpensive to produce, and existing blades can easily be modified to incorporate the invention to provide improved wear resistance characteristics.

Figures 1A, 1B:
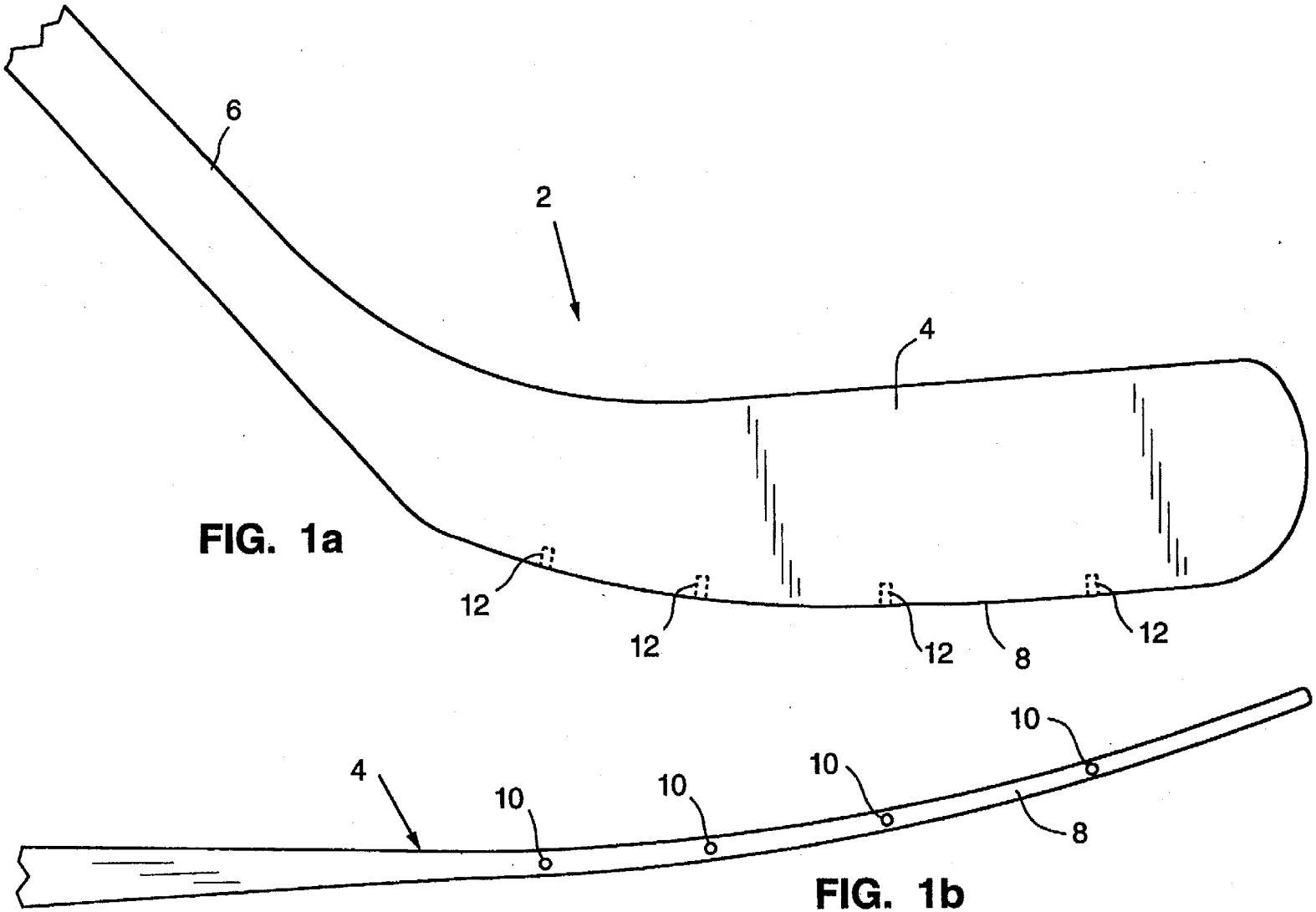
FIG. 1*a* is a side view of the blade portion of the preferred embodiment of the present invention.
FIG. 1*b* is a bottom view of the blade portion of the preferred embodiment of the present invention.

The street hockey stick of the preferred embodiment is illustrated in FIGS. 1*a* and 1*b*. The hockey stick 2 has a stick blade 4 that is integrally formed or otherwise attached to the handle portion 6 of hockey stick 2. The stick blade 4 has a plastic core, preferably made of acrylonitrile butadiene styrene (ABS), which extends to the bottom edge 8 of the stick blade. 4. A plurality of cylindrical recesses 10 are formed in spaced relationship along the bottom edge 8 of stick blade 4. A plurality of rods 12 are formed or inserted into recesses 10. Rods 12 are formed of a material that has higher wear resistant characteristics than the plastic used to form the stick blade 4.

To optimally resist abrasion, the bottom of the blade 4 should contain materials which are more wear-resistant than the most abrasive component of the playing surface. The most abrasive playing surface for street hockey is an asphalt surface. A typical asphalt surface is a mixture of 5% asphalt and 95% aggregate. Aggregate supplies the compressive strength and abrasion resistance and the asphalt binder holds the composite together. Therefore, abrasion of stick blades is due to wear against the aggregate component of the asphalt surface. The aggregate component of asphalt surfaces varies. In the San Francisco Bay Area, for example, asphalt typically has an aggregate comprised of limestone, granite, or basalt.

The rods 12 of the preferred embodiment are made of transformation toughened zirconia ceramic (TTZ), which is more wear resistant and harder than most aggregate materials used to make asphalt. TTZ is also less brittle, and therefore tougher and more wear resistant than other ceramics, which makes TTZ an ideal material for rods 12. The toughening is a consequence of the presence of a metastable phase, which is present in the finished product ceramic due to a quenching process. Crack propagation is inhibited because the propagating crack creates a local stress, and the TTZ relieves this stress by undergoing a localized phase transformation, which dissipates the crack.

Although TTZ ceramic is the preferred material for rods 12, other materials that are more wear resistant than typical aggregates used in asphalt are also ideal to form rods 12, including hardened steel, silicon carbide, boron carbide, cubic boron nitride, silicon nitride, diamond, various zirconates, tungsten carbide, and some other ceramics and traditional metal carbides. Increased wear resistance of any blade 4, however, will be evidenced with rods 12 made of any material that is more wear resistant than the material used to form the bottom blade edge 8.

In the preferred embodiment, four cylindrical recesses 10 are formed in the bottom edge 8. These recesses 10 have a diameter of about 0.123 inches and a depth of about 0.25 inches. Four rods 12 are mounted into the recesses 10. Rods 12 are made of TTZ ceramic, and are about 0.125 inches in diameter and 0.25 inches in length. The existence of four ceramic rods 12 in the blade 4 has been found to adequately reduce abrasion of the stick blade 4, without adversely affecting the feel and performance of the hockey stick 2.

Tests have shown that an ABS plastic block having TTZ ceramic rods exhibits less than 6% of the wear measured from an ABS plastic block with no ceramic rods. To further illustrate the effectiveness of inserting rods 12 in blade edge 8, the wear of unprotected blades was compared to the wear exhibited by blades equipped with three ceramic rods or three case-hardened steel rods under actual playing conditions. Each of the tested blades were made of ABS plastic and were used by the inventor over about 55 hours of actual playing time on an asphalt surface. While the wear of the blades varied slightly over different portions of the blade edge 8, the effect of adding three rods to the ABS plastic blades was dramatic. The blade having three case-hardened steel rods exhibited less than 10% of the wear exhibited by an unprotected blade. Further, the blade having three TTZ ceramic rods exhibited less than 3% of the wear exhibited by an unprotected blade. In fact, only the blade portions between the ceramic rods exhibited wear, as there was no measurable wear on the TTZ ceramic rods themselves.

Figure 5A:
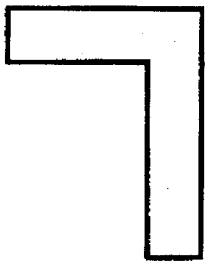
FIG. 5 *a–c* are side views of a rod illustrating different shapes thereof.
Figure 5B:
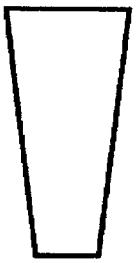
Figure 5C:
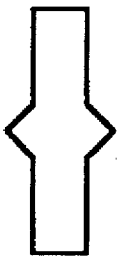

There are several effective means for securing rods 12 within the recesses 10. One effective and economical means is to press-fit rods 12 into recesses 10, which are under-sized relative to the diameter of rods 12. Typically an under-sizing of the recesses 10 by 0.0005 to 0.002 inches sufficiently secures rods 12 in the recesses 10. Other alternate means of securing rods 12 in recesses 10 can include forming male and female snap features into the rods and holes, insert molding (i.e. for injection molded plastic blades) of rods 12 into the blade 4 during manufacture, altering the rod's shape (such as an L shape or having tapered or ridged sides, as shown in FIGS. 5 *a–c*), and using adhesives (such as cyanoacrylates).

The playing performance of the hockey stick 2 is a critical aspect of the present invention, and is not adversely affected by the incorporation of rods 12 into the blade's bottom edge 8. Rods 12 do not alter the basic geometry of the blade 4. There are no obstacles added to the surface of the blade 4 upon which the puck impacts. Further, the weight distribution change due to the introduction of rods 12 is minimal. Rods 12 are relatively small, and the TTZ material has a similar density to the ABS plastic used in many blades. The total change in stick weight after introduction of rods 12 is much less than 1%. Additionally, the geometric distribution of rods 12 is such that they are centered along the stick blade bottom 8, resulting in no overall weight shift in the blade 4. Finally, during normal use, rods 12 project only slightly out of the bottom edge 8. These projections are caused by the slight abrasion of the blade edge 8 portions located between rods 12. These small protrusions not only provide a safe blade edge 8, but also can slightly reduce the friction between the blade 4 and the playing surface since such contact is largely limited to the pin locations.

Even though the preferred embodiment uses four rods 12, the number of rods 12 and rod locations can vary, depending upon rod substance, the material used to form the blade 4, the particular composition of the playing surface, the desired wear resistance, and even the particular play characteristics of each individual player. Further, the length and size of rods 12 can also vary. Since wear tests have shown that ceramic wear is negligible even over constant prolonged use of the hockey stick 2 of the present invention, the length of rods 12 need only be as long as is necessary to secure rods 12 in the recesses 10.

The rods 12 can vary in size and/or have differing wear resistance characteristics from one another on a single stick. Different players tend to wear certain portions of the stick edge 8 more than other portions. Therefore, larger or more wear resistant rods 12 can be inserted or formed in those portions of the blade edge 8 that exhibit more wear during use.

The rods 12 of the present invention can also be inserted into the more traditional wooden-bladed hockey sticks that are typically used in ice hockey. Even the relatively smooth ice hockey surface can cause excessive wear on a wooden stick blade edge 8. Therefore, rods 12 that are more wear resistant than the wooden blade 4 inserted into the blade edge 8 result in decreased wear of the wooden stick's bottom edge. Further, rods 12 inserted into the wooden blade 4 also prevent wear and splintering of the wooden blade 4 during play on a playing surface that is more abrasive than ice, such as a paved playing surface.

Figures 2A, 2B:
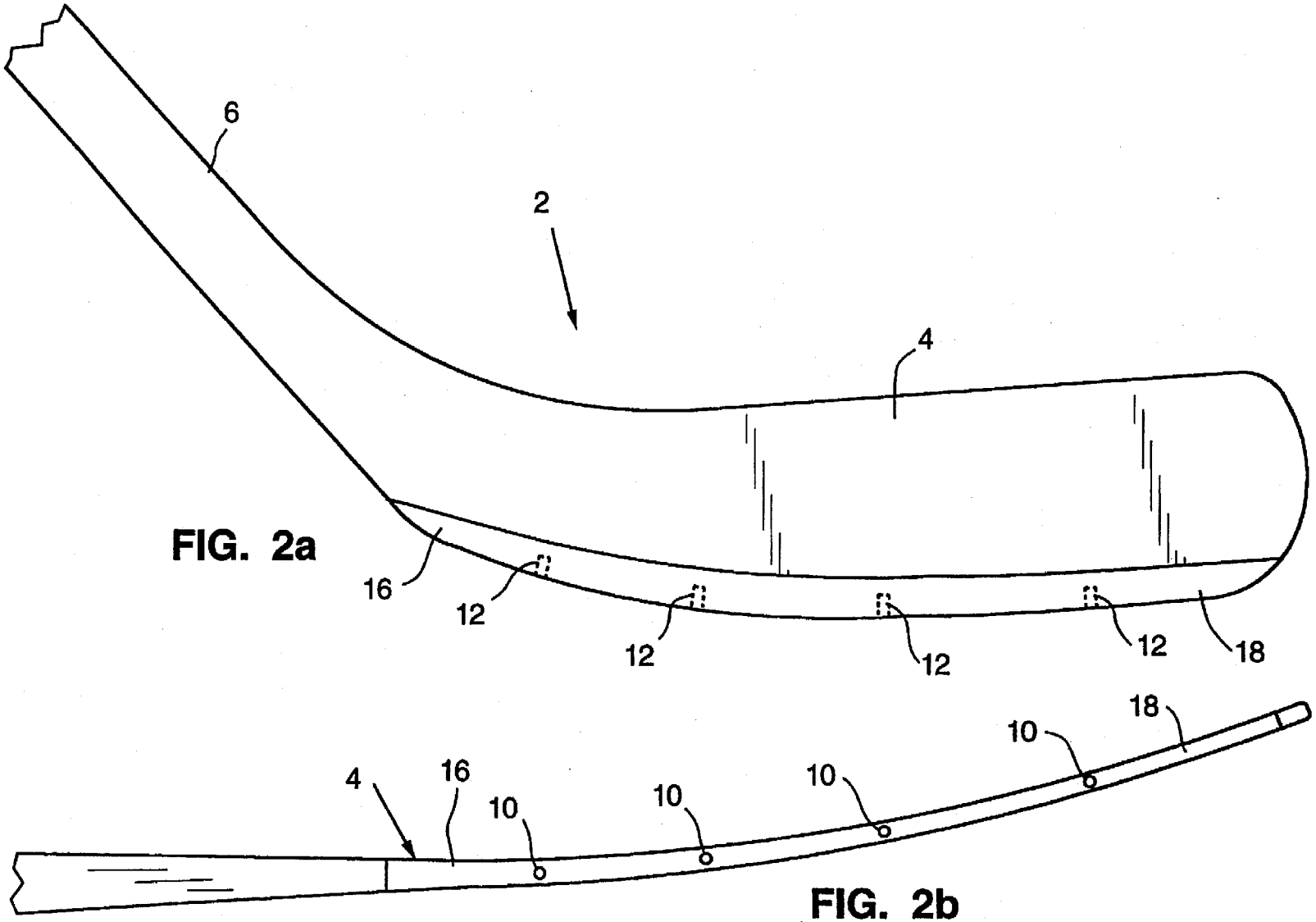
FIG. 2*a* is a side view of the blade portion of an alternate embodiment of the present invention.
FIG. 2*b* is a bottom view of the blade portion of the alternate embodiment of the present invention.

An alternate embodiment of the present invention is illustrated in FIGS. 2*a* and 2*b*. Instead of the entire blade 4 being made of plastic, a strip of plastic 16 can be attached to the bottom edge 8 of a composite or wooden stick blade 4. The plastic strip 16 has recesses 10 and rods 12 on its bottom edge 18. The plastic strip allows the player to enjoy all the advantages of a composite or wooden blade 4, such as stiffness, spring constant, and overall "feel" of sticks having a wooden or composite blade. Such a blade will not exhibit the splintering or wear associated with such blade construction. The strip of plastic 16, preferably ABS plastic, can be attached by adhering the strip to the blade, by laminating the strip to the blade, by embedding the strip into the blade, or even by extending rods 12 through the plastic strip and into the blade portion 4 itself.

Figure 3A:
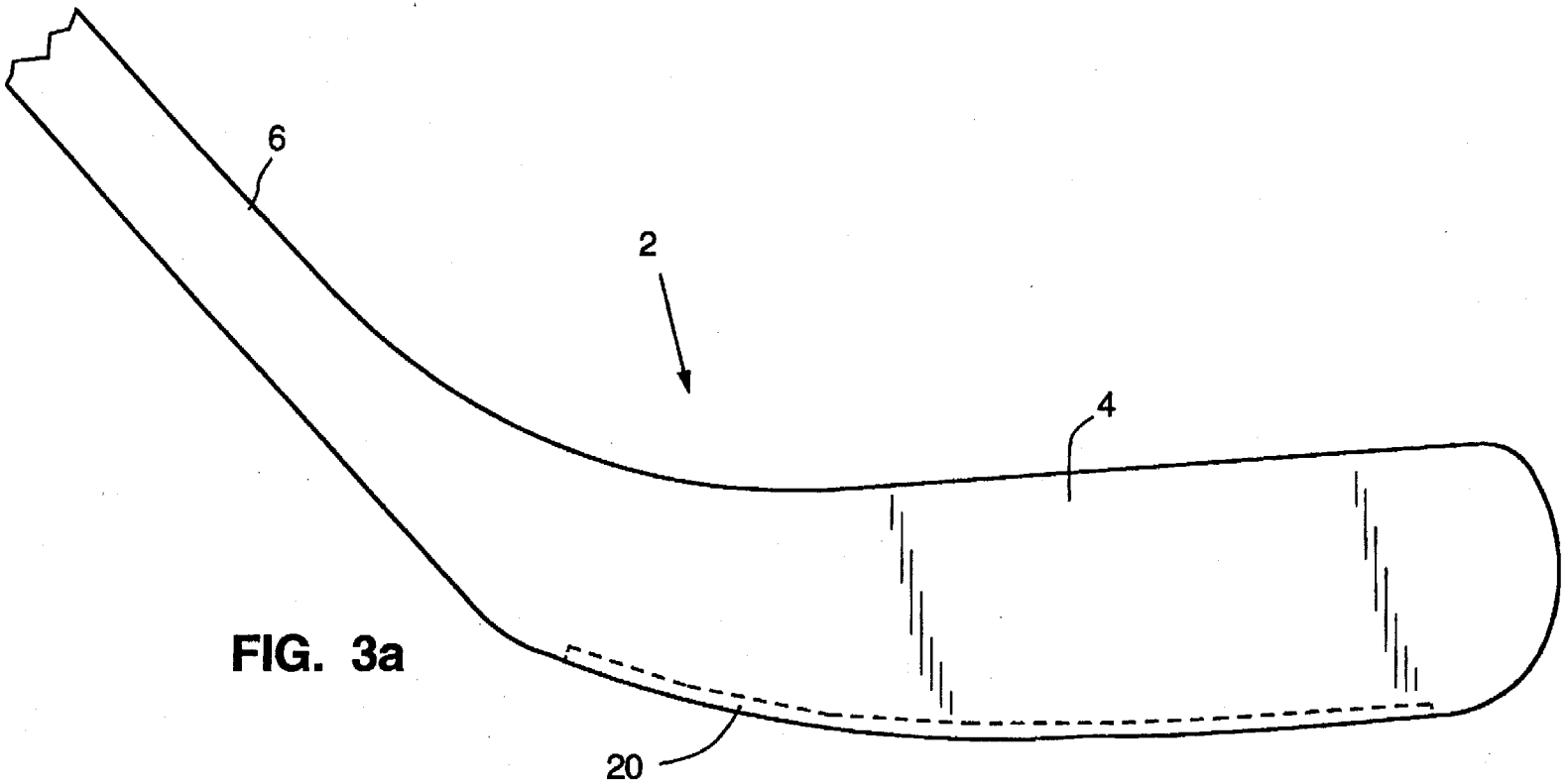
FIG. 3*a* is a side view of the blade portion of a second alternate embodiment of the present invention.
Figure 3B:
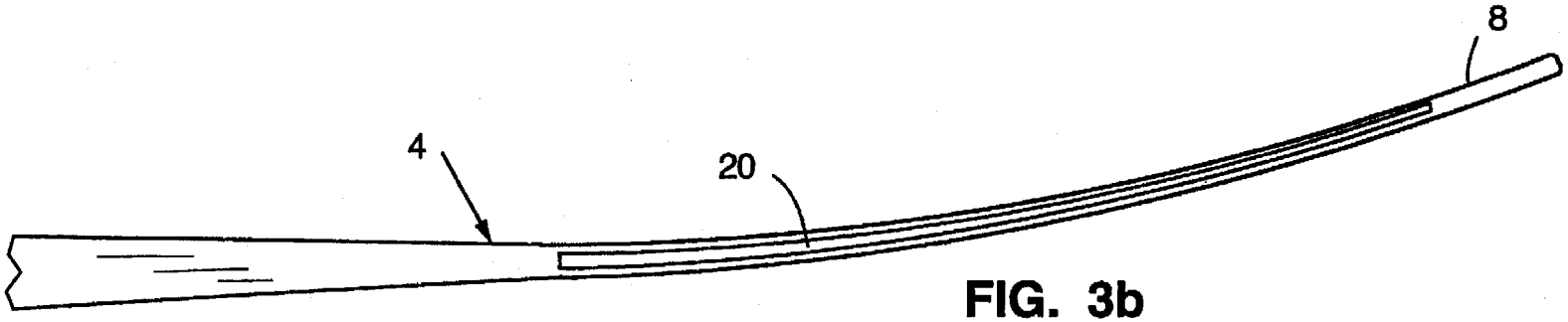
FIG. 3*b* is a bottom view of the blade portion of the second alternate embodiment of the present invention.
Figure 4A:
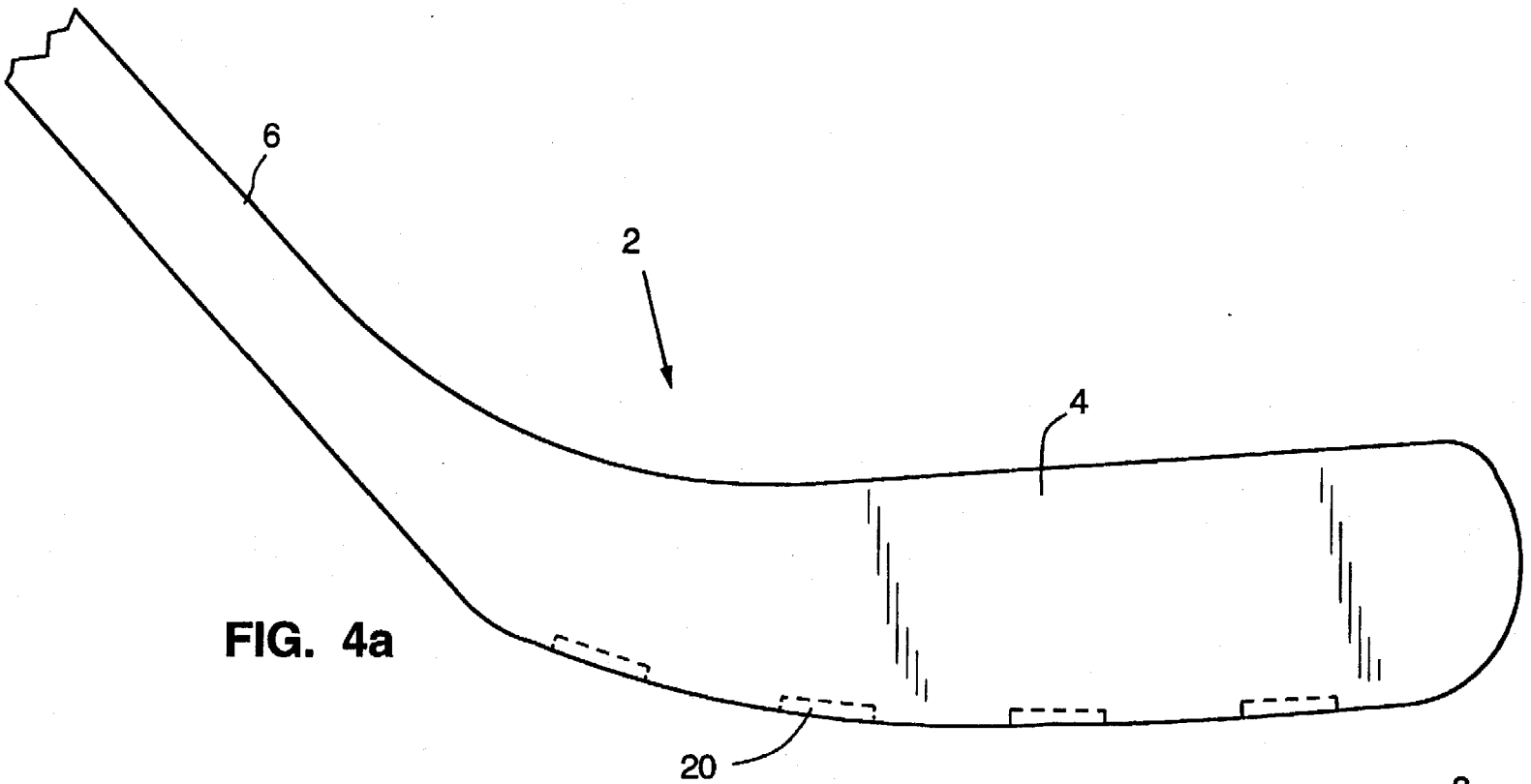
FIG. 4*a* is a side view of the blade portion of a third alternate embodiment of the present invention.
Figure 4B:
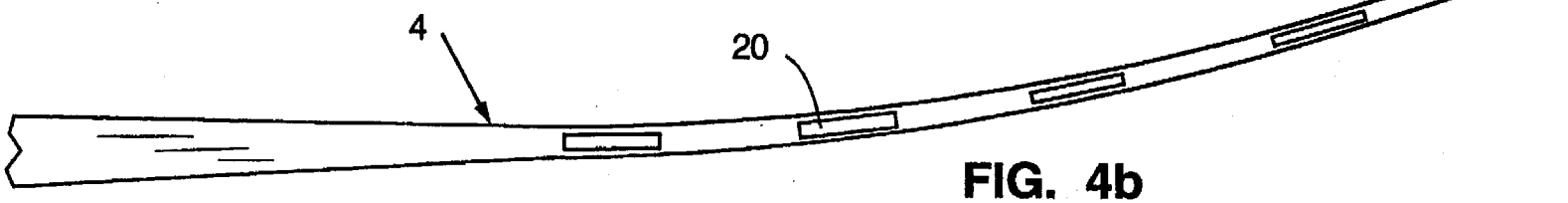
FIG. 4*b* is a bottom view of the blade portion of the third alternate embodiment of the present invention.

Second and third alternate embodiments of the present invention are illustrated in FIGS. 3*a*, 3*b*, 4*a*, and 4*b*. One or more elongated wear resistant members 20 are formed or inserted parallel to and abutting the blade edge 8. There can be a single member 20 along the blade edge 8, as shown in FIGS. 3*a* and 3*b*, or a plurality of members 20 along the blade edge 8, as shown in FIGS. 4*a* and 4*b*. The wear resistant members 20 can be of any material that is more wear resistant than the material used to form the blade edge 8. If a single member 20 is used, the size of the exposed surface of member 20 can vary over the length of edge 8 to provide increased wear protection for predetermined portions of edge 8. If multiple members 20 are used, one or more members 20 can have increased wear resistance (either through added size or differing composition) to provide added wear protection for those portions of the blade edge 8 that exhibit the most wear during use. These embodiments are ideal for those applications where a larger exposure of the wear resistant member material is desired along blade edge 8.

It is to be understood that the present invention is not limited to the embodiments described above and illustrated herein. For example, the number, composition, dimension and location of rods 12 or members 20 can vary depending on the abrasion resistance needs of the player. Further, the shape of the rods 12 or members 20 can vary from the cylindrical or strip shape shown in the above embodiments. In addition, the blade need not be made of wood or ABS plastic, but could be made of other materials such as other plastics or fiberglass or composites laminated together. Moreover, the blade of the present invention can be used on other playing surfaces than ice or paved surfaces. Lastly, the rod 12 need not be formed or inserted into blade 4 at substantially right angles to the blade edge 8, as shown in the first two embodiments.

What is claimed is:

1. A wear resistant hockey stick blade for use with a hockey stick handle, comprising:

a blade member adopted for connection to the hockey stick handle and being made of a first material, said blade member having a bottom playing edge;

a first wear resistant member disposed inside said blade member having a surface portion thereof extending to and being flush with said bottom playing edge, first wear resistant member being formed of a second material that is more wear resistant than said first material; and a second wear resistant member disposed inside said blade member having a surface portion thereof extending to and being flush with said bottom playing edge and being formed of a third material that is more wear resistant than said first and second materials, wherein said first and second wear resistant members are disposed along said bottom playing edge to provide a varying wear resistance protection for selected portions of said bottom playing edge.

2. A wear resistant hockey stick blade for use with a hockey stick handle, comprising;

a blade member adopted for connection to the hockey stick handle and being made of a first material, said blade member having a bottom playing edge; and a first plurality of wear resistant members disposed in spaced relationship inside said blade member each having a surface portion thereof extending to and being flush with said bottom playing edge, said first plurality of wear resistant members being formed of a said second material that is more wear resistant than said first material;

wherein the surface area exposure to said bottom playing edge of at least one of said first plurality of wear resistant members is varied from the rest of said first plurality of wear resistant members to provide a varying wear resistance protection over selected portions of said bottom playing edge.

3. The hockey stick blade of claim 2, wherein said blade member has a plurality of recesses formed therein, said recesses terminating in openings within said bottom playing edge and being positioned in spaced relationship along said bottom playing edge into which said first plurality of wear resistant members are inserted.

4. The hockey stick blade of claim 2, wherein said first plurality of wear resistant members are sized and disposed inside said blade member so as to not materially affect the overall geometry, weight, weight distribution and smoothness of said blade member.

5. The hockey stick blade of claim 2, wherein:

said first material is one of plastic, wood, and wood laminated with fiberglass mesh; and said second material is one of ceramic, TTZ ceramic, steel, diamond, and metal carbide.

6. The hockey stick blade of claim 2, wherein said first plurality of wear resistant members have side surfaces and end surfaces, and have a shape such that at least one portion of said side surface is other than substantially perpendicular to said bottom playing edge of said blade member.

7. A wear resistant hockey stick blade for use with a hockey stick handle, comprising:

a blade member adopted for connection to the hockey stick handle and being made of a first material, said blade member having a bottom playing edge;

a first plurality of wear resistant members disposed in spaced relationship inside said blade member each having a surface portion thereof extending to and being flush with said bottom playing edge, said first plurality of wear resistant members being formed of a second material that is more wear resistant than said first material; and a second plurality of wear resistant members disposed in spaced relationship inside said blade member each having a surface portion thereof extending to and being flush with said bottom playing edge, and being made of a third material that is more wear resistant than said first and second materials, wherein said first and second pluralities of wear resistant members are disposed along said bottom playing edge to provide a varying wear resistance protection for selected portions of said bottom playing edge.

8. A wear resistant hockey stick, comprising;

a handle portion;

a blade portion connected to the handle portion and being made of a first material, said blade portion having a bottom playing edge;

a first wear resistant member disposed inside said blade portion having a surface portion thereof extending to and being flush with said bottom playing edge, said first wear resistant member being formed of a second material that is more wear resistant than said first material; and a second wear resistant member disposed inside said blade portion having a surface portion thereof extending to and being flush with said bottom playing edge and being formed of a third material that is more wear resistant than said first and second materials, wherein said first and second wear resistant members are disposed along said bottom playing edge to provide a varying wear resistance protection for selected portions of said bottom playing edge.

9. A wear resistant hockey stick, comprising:

a handle portion;

a blade portion connected to the handle portion and being made of a first material, said blade portion having a bottom playing edge; and a first plurality of wear resistant members disposed in spaced relationship inside said blade portion each having a surface portion thereof extending to and being flush with said bottom playing edge, said first plurality of wear resistant members being formed of said second material that is more wear resistant than said first material;

wherein the surface area exposure to said bottom playing edge of at least one of said fast plurality of wear resistant members is varied from the rest of said first plurality of wear resistant members to provide a varying wear resistance protection over selected portions of said bottom playing edge.

10. The hockey stick of claim 9, wherein said handle portion and said blade portion are integrally formed of said first material.

11. The hockey stick of claim 9, wherein said blade portion has a plurality of recesses formed therein, said recesses terminating in openings within said bottom playing edge and being positioned in spaced relationship along said bottom playing edge into which said first plurality of wear resistant members are inserted.

12. The hockey stick of claim 9, wherein said first plurality of wear resistant members are sized and disposed inside said blade portion so as to not materially affect the overall geometry, weight, weight distribution and smoothness of said blade portion.

13. The hockey stick of claim 9, wherein:

said first material is one of plastic, wood, and wood laminated with fiberglass mesh; and said second material is one of ceramic, TTZ ceramic, steel, diamond, and metal carbide.

14. The hockey stick of claim 9, wherein said first plurality of wear resistant members have side surfaces and end surfaces, and have a shape such that at least one portion of said side surface is other than substantially perpendicular to said bottom playing edge of said blade portion.

15. A wear resistant hockey stick, comprising:

a handle portion;

a blade portion connected to the handle portion and having a bottom playing edge;

a strip member affixed to said bottom playing edge of said blade portion and being made of a first material, said strip member having an outer playing edge opposite said bottom playing edge of said blade portion; and a first wear resistant member disposed inside said strip member having a surface portion thereof extending to and being flush with said outer playing edge, said first wear resistant member being formed of a second material that is more wear resistant than said first material.

16. The hockey stick of claim 15, further comprising:

a second wear resistant member disposed inside said strip member having a surface portion thereof extending to and being flush with said outer playing edge, said second wear resistant member being formed of a third material that is more wear resistant than said first and second materials, wherein said first and second wear resistant members are disposed along said outer playing edge to provide a varying wear resistance protection for selected portions of said outer playing edge.

17. The hockey stick of claim 15, further comprising:

a first plurality of wear resistant members which includes said first wear resistant member, said plurality of wear resistant members being disposed in spaced relationship inside said strip member each having a surface portion thereof extending to and being flush with said outer playing edge, said first plurality of wear resistant members being formed of said second material that is more wear resistant than said first material.

18. The hockey stick of claim 11, wherein said handle portion and said blade portion are integrally formed of said first material.

19. The hockey stick of claim 11, wherein said strip member has a plurality of recesses formed in spaced relationship therein, said recesses terminating in openings within said outer playing edge and being positioned along said outer playing edge into which said first plurality of wear resistant members are inserted.

20. The hockey stick of claim 11, wherein said first plurality of wear resistant members are sized and disposed inside said strip member so as to not materially affect the overall geometry, weight, weight distribution and smoothness of said strip member.

21. The hockey stick of claim 11, wherein the surface area exposure to said outer playing edge of at least one of said first plurality of wear resistant members is varied from the rest of said first plurality of wear resistant members to provide a varying wear resistance protection for selected portions of said outer playing edge.

22. The hockey stick of claim 11, wherein said strip member further includes a second plurality of wear resistant members disposed in spaced relationship inside said strip member each having a surface portion thereof extending to and being flush with said outer playing edge, and being made of a third material that is more wear resistant than said first and second materials, wherein said first and second pluralities of wear resistant members are disposed along said outer playing edge to provide a varying wear resistance protection for selected portions of said outer playing edge.

23. The hockey stick of claim 11, wherein:

said first material is one of plastic, wood, and wood laminated with fiberglass mesh; and said second material is one of ceramic, TTZ ceramic, steel, diamond, and metal carbide.

24. The hockey stick of claim 11, wherein said first plurality of wear resistant members have side surfaces and end surfaces, and have a shape such that at least one portion of said side surface is other than substantially perpendicular to said outer playing edge of said strip member.

25. A wear resistant hockey stick blade for use with a hockey stick handle, comprising:

a blade member adopted for connection to the hockey stick handle and having a bottom playing edge;

a strip member affixed to said bottom playing edge of said blade member and being made of a first material, said strip member having an outer playing edge opposite said bottom playing edge of said blade member; and a first wear resistant member disposed inside said strip member having a surface portion thereof extending to and being flush with said outer playing edge, said first wear resistant member being formed of a second material that is more wear resistant than said first material.

26. The hockey stick blade of claim 25, further comprising:

a second wear resistant member disposed inside said strip member having a surface portion thereof extending to and being flush with said outer playing edge and being formed of a third material that is more wear resistant than said first and second materials, wherein said first and second wear resistant members are disposed along said outer playing edge to provide a varying wear resistance protection for selected portions of said outer playing edge.

27. The hockey stick blade of claim 25, further comprising:

a first plurality of wear resistant members which includes said first wear resistant member, said first plurality of wear resistant members being disposed in spaced relationship inside said strip member each having a surface portion thereof extending to and being flush with said outer playing edge, said first plurality of wear resistant members being formed of said second material that is more wear resistant than said first material.

28. The hockey stick blade of claim 27, wherein said strip member has a plurality of recesses formed in spaced relationship therein, said recesses terminating in openings within said outer playing edge and being positioned along said outer playing edge into which said first plurality of wear resistant members are inserted.

29. The hockey stick blade of claim 27, wherein said first plurality of wear resistant members are sized and disposed inside said strip member so as to not materially affect the overall geometry, weight, weight distribution and smoothness of said strip member.

30. The hockey stick blade of claim 27, wherein the surface area exposure to said outer playing edge of at least one of said first plurality of wear resistant members is varied from the rest of said first plurality of wear resistant members to provide a varying wear resistance protection over selected portions of said outer playing edge.

31. The hockey stick blade of claim 27, wherein said strip member further includes a second plurality of wear resistant members disposed in spaced relationship inside said strip member each having a surface portion thereof extending to and being flush with said outer playing edge, and being made of a third material that is more wear resistant than said first and second materials, wherein said first and second pluralities of wear resistant members are disposed along said outer playing edge to provide a varying wear resistance protection for selected portions of said outer playing edge.

32. The hockey stick blade of claim 27, wherein:

said first material is one of plastic, wood, and wood laminated with fiberglass mesh; and said second material is one of ceramic, TTZ ceramic, steel, diamond, and metal carbide.

33. The hockey stick blade of claim 27, wherein said first plurality of wear resistant members have side surfaces and end surfaces, and have a shape such that at least one portion of said side surface is other than substantially perpendicular to said outer playing edge of said strip member.

34. A wear resistant hockey stick, comprising:

a handle portion;

a blade portion connected to the handle portion and being made of a first material, said blade portion having a bottom playing edge; and a first plurality of wear resistant members disposed in spaced relationship inside said blade portion each having a surface portion thereof extending to and being flush with said bottom playing edge, said first plurality of wear resistant members being formed of said second material that is more wear resistant than said first material;

wherein said blade portion further includes a second plurality of wear resistant members disposed in spaced relationship inside said blade portion each having a surface portion thereof extending to and being flush with said bottom playing edge, and being made of a third material that is more wear resistant than said first and second materials, wherein said first and second pluralities of wear resistant members are disposed along said bottom playing edge to provide a varying wear resistance protection for selected portions of said bottom playing edge.

* * * * *